US006162515A

United States Patent [19]

Hill

[11] Patent Number: 6,162,515

[45] Date of Patent: Dec. 19, 2000

[54] ILLUMINATED TREE STRUCTURE

[76] Inventor: Eric Hill, 1411 Blueberry Dr., Sneads, Fla. 32460

[21] Appl. No.: 09/379,255

[22] Filed: Aug. 23, 1999

[51] Int. Cl.[7] ..... F21S 6/00

[52] U.S. Cl. ..... 428/20; 362/123; 211/196

[58] Field of Search ..... 428/20; 362/123, 362/806; 211/196

[56] References Cited

U.S. PATENT DOCUMENTS

| | | | |
|---|---|---|---|
| D. 390,806 | 2/1998 | Skarda | D11/118 |
| 5,359,502 | 10/1994 | Cantin | 362/123 |
| 5,712,002 | 1/1998 | Reilly | 428/20 |

*Primary Examiner*—Alexander S. Thomas
*Attorney, Agent, or Firm*—Carnes Cona Dixon

[57] ABSTRACT

The present invention is a lighted tree structure comprising a hollow central pole having a top end and a lower end. Secured to the top end is an end cap; while secured to the lower end is an attaching device for attaching the tree structure to a particular surface, such as the ground. A lifting and lowering mechanism is slideably mounted to the central pole. Pivotally secured to the end cap are a plurality of hollow branches. Located within each branch is an illuminated device. A pivot bar is secured to each branch and to the lifting and lowering mechanism to enable the branches to extend outward when in a display position and collapsed when in a storable position.

18 Claims, 4 Drawing Sheets

ILLUMINATED TREE STRUCTURE

BACKGROUND OF THE INVENTION

1. Field of the Invention

The present invention relates generally to a collapsible lighted tree structure and more particularly to an illuminated tree structure having a plurality of support branches housing and protecting conventional lights that extend outwardly from the top of the tree for innately providing an aesthetically as well as a realistic means for stimulating a tree when illuminated and viewed at night.

2. Description of the Prior Art

Christmas has long been recognized as a ceremonious holiday. Many get into the festive mood by decorating and ornating their homes, offices, residences, and like, both interiorly and exteriorly. The market has been inundated with gadgets to make the decorating process safe, easy and fun. One area, which has been very popular for years, is to provide lights on a skeleton frame, such as a tree. This idea will allow for any individual to simply provide lights to a frame, so as to allow for the outline of the frame to simulate the object formed.

To expand on this idea, several devices have been developed. One such device is disclosed in U.S. Pat. No. 5,712,002, issued to Reilly, III. In this patent there is disclosed a telescopic lighted tree apparatus. This lighted tree apparatus includes a central telescopic pole having a plurality of hooks locked thereon. Extending downwardly and outwardly from the top of the pole is a plurality of guidelines. These guidelines form a tree shape. Lights are suspended in strands between the guidelines and the hooks. The affect does achieve a tree outline, however, this decorated tree can be difficult and cumbersome to assemble and disassemble. In addition, the strand of lights must be wrapped from the inside to the outside, a task that appears to require extreme flexibility and dexterity, something all consumers may not possess.

Other devices approach attaching lights to tree structures, such as in U.S. Pat. No. 5,359,502 issued to Cantin and Design Patent No. Des. 390,806 issued to Skarda, Jr. In these patents, a frame is provided and the user must attach the lights to the frame. Though these devices do provide an adequate frame, they fail to provide an ornate structure, which can be assembled quickly, and one, which requires only a minimum amount of steps for adequately erecting a lighted frame.

Accordingly, it is seen that what is needed is a device that requires a minimal amount of effort to assemble. This device should also provide a more durable and a fuller illuminous final produce, as opposed to the frames that are conventionally available, to consequently provide for a more aesthetically pleasing and longer lasting final product. This device should be sturdy and durable, so as to allow for it to remain in an upright position, even in the presence of increment weather.

As will be seen, the present invention achieves its intended purposes, objectives and advantages, by accomplishing the needs as identified above, through a new, useful and unobvious combination of component elements, which are simple to use, with the utilization of a minimum number of functioning parts, at a reasonable cost to manufacture, assemble, test and by employing only readily available material.

SUMMARY OF THE INVENTION

The present invention is a lighted tree structure that is designed and configured to provide adequate and sufficient lighting for rendering the illusion of a lighted evergreen tree, generally those associated with Christmas trees. The lighted tree structure of the present invention comprises a hollow central pole having a plurality of branches or supports extending downwardly therefrom, when in an extended and displayed position.

Each branch or support is a hollow structure that is fabricated from a sturdy material. These branches will maintain the lights in a fixed and secured position within the hollow structure. This will innately provide for the branches to house and protect the lights from the harsh outdoor elements, such as rain, snow, extreme cold or the like, for inherently prolonging their life.

The branches are designed to be slideably and collaspsibly attached to the pole. This will allow for the branches to extend outward when displayed and be in a downward position, abutting the main pole when in a storable and non-usable position. Even in the stored position, the lights are protected via the hollow structure of each branch.

Wiring that is used to supply current to the lights are housed within the main pole. This will provide for the pole and each branch to house all electrical components, thereby providing for a product that does not permit the user to couple a strand of lights to one other. This situation will inherently reduce the chance of working with lights that may have precarious plugs, and consequently provide for a product that is safe and easy to use.

Located in proximity to the lower end of the pole is an aperture. This aperture receives the plug for enabling the tree to be coupled to a power source. The lower end of the pole also includes a stake with enables the device to be anchored to the ground or the like.

In use, the user secures the lower end of the pole to the ground. Once secured, the branches are lifted upward and locked into place. In the locked position, the tree can be coupled to a power supply to allow for the branches to illuminate. Providing illumination from the top of the branch to its outer ends provides for a very aesthetically pleasing illumination. Depthness is obtain and the final product (illuminated tree) looks full and beautiful.

Accordingly, it is the object of the present invention to provide for a lighted structure which will overcome the deficiencies, shortcomings, and drawbacks of prior seasonal lighted display devices and methods thereof.

Another object of the present invention, to be specifically enumerated herein, is to provide a lighted structure in accordance with the preceding objects and which will conform to conventional forms of manufacture, be of simple construction and easy to use so as to provide a device that would be economically feasible, long lasting and relatively trouble free in operation.

Although there have been many inventions related to a lighted tree structure, none of the inventions have become sufficiently compact, low cost, and reliable enough to become commonly used. The present invention meets the requirements of the simplified design, compact size, low initial cost, low operating cost, ease of installation and maintainability, and minimal amount of training to successfully employ the invention.

The foregoing has outlined some of the more pertinent objects of the invention. These objects should be construed to be merely illustrative of some of the more prominent features and application of the intended invention. Many other beneficial results can be obtained by applying the disclosed invention in a different manner or modifying the invention within the scope of the disclosure. Accordingly, a fuller understanding of the invention may be had by referring to the detailed description of the preferred embodiments in addition to the scope of the invention defined by the claims taken in conjunction with the accompanying drawings.

BRIEF DESCRIPTION OF THE DRAWINGS

Similar reference numerals refer to similar parts throughout the several views of the drawings.

DESCRIPTION OF THE PREFERRED EMBODIMENTS

Figure 1:
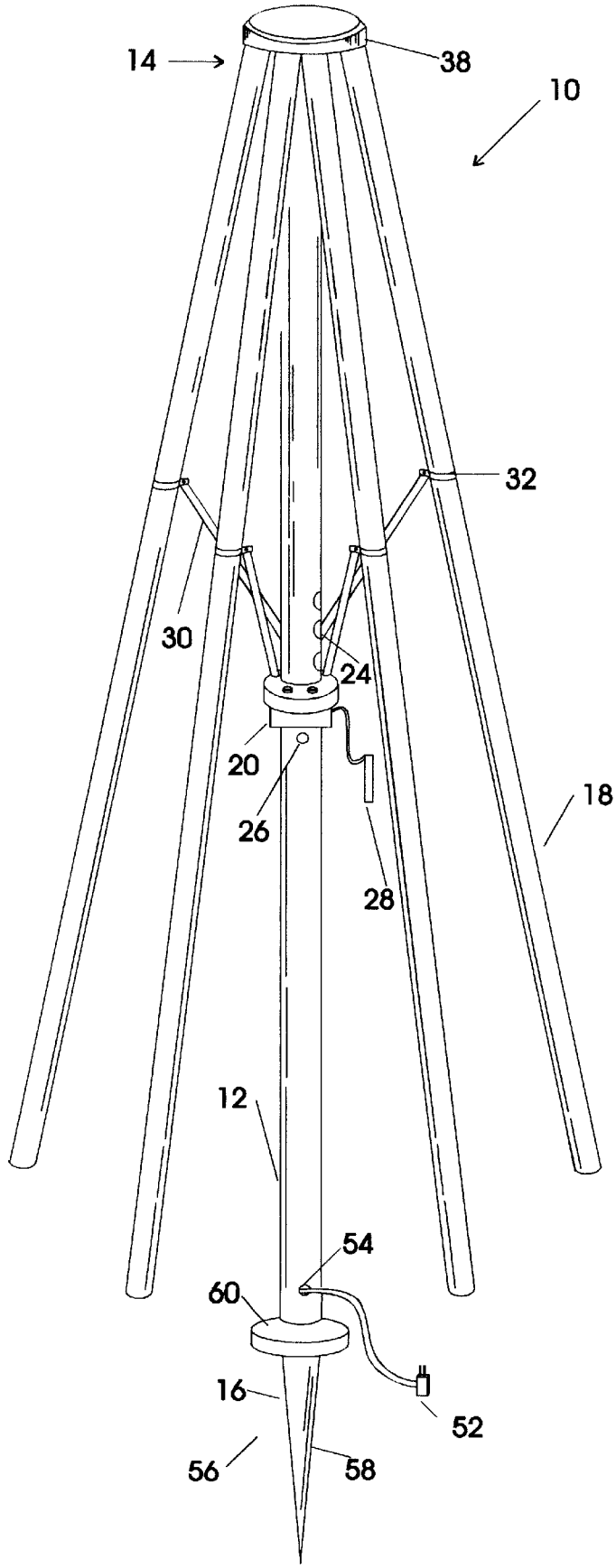
FIG. 1 is a front view of the illuminated tree structure of the present invention, in an extended and useable position and partially illustrating a few branches attached thereto.

As seen in the drawings, in particular to FIGS. 1–4*c* there is shown an illuminated tree structure, denoted by reference numeral 10, which is designed and configured to be in an extended position for viewing (illustrated in FIG. 1), and a lowered position (illustrated in FIG. 2) for storage.

Figure 2:
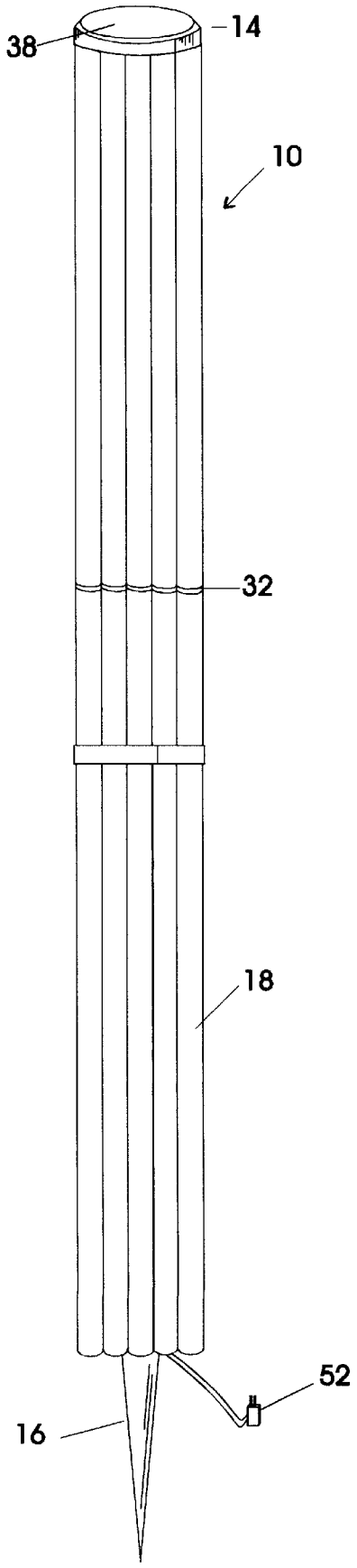
FIG. 2 is a front view of the illuminated tree structure of the present invention, in a collapsed and foldable position.

Shown in FIGS. 1 and 2, is the illuminated tree structure 10 comprising a hollow main pole or shaft 12 having a top end 14 and a lower end 16. Slidably secured to the pole is a plurality of branches 18 having illumination devices located therein. The branches are affixed to the pole via an extending and lowering mechanism 20. This extending and lowering mechanism allows for the branches 18 to be extended (seen in FIG. 1) or lowered (seen in FIG. 2). A strap, illustrated in FIG. 2, but not labeled, can be used to secure the device in a collapsed position.

Figure 3A:
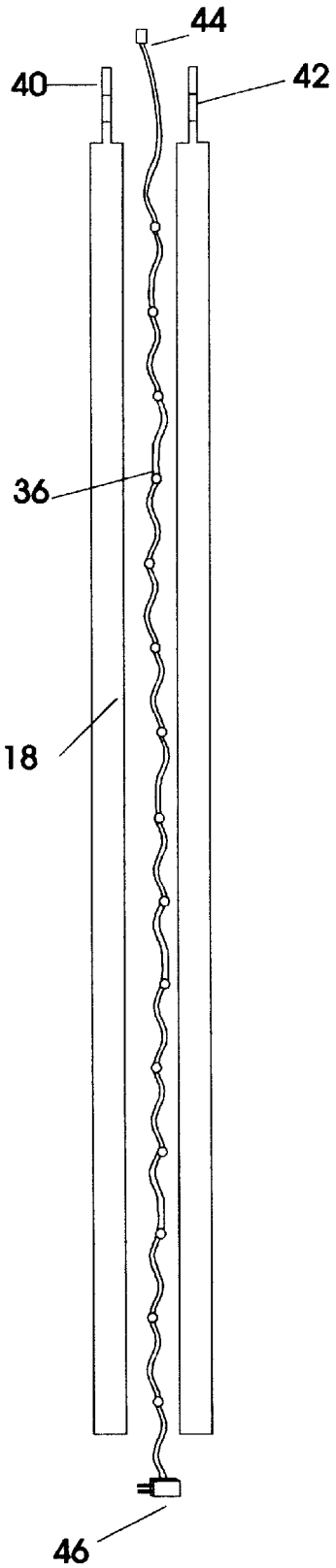
FIG. 3*a* is an enlarged view cross-sectional view of a branch of the present invention, having a set of conventional lights located therein.
Figure 3B:
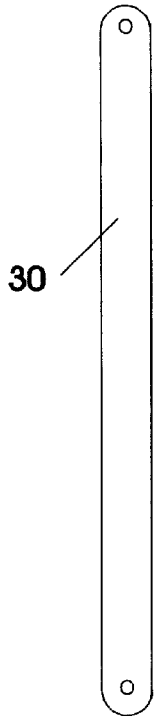
FIG. 3*b* is a front view of the pivot bar secured to the branch and extending lowering mechanism, for enabling the branch to be pivotally secured to the shaft.
Figure 3C:
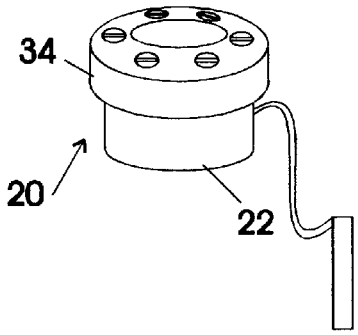
FIG. 3*c* is an enlarged front view of the extending and lowering mechanism used in the illuminated tree structure of the present invention.

The extending and lowering mechanism, or adjusting device 20, seen in FIGS. 1 and 3*c*, comprises a hollow collar 22 slideably mounted to the main pole 12. This arrangement will enable the collar to slide freely on the main pole. The pole 12 further includes a plurality of apertures 24 extending therethrough. This plurality of apertures 24 in combination with the adjusting device 24 allows for the tree to in an extended and displayable position.

When desired to utilize the tree structure and to display the illumination of the device, the collar 22 is lifted upward to the desired height, in proximity to one of the apertures 24 located within the pole. Once the desired height is achieved, a locking pin 28 is inserted into the respective aperture and provides for the collar to be located above the respective aperture. Once inserted therein, the pin will extend from the aperture and act as a stop so as to prevent the collar 22 from sliding downward. Hence, locking 28 the collar 22 into a secured and fixed position. The locking pin 28 can be secured to the collar 22 via conventional means, such as the use of string (as illustrated but not labeled), elastic, chain or the like. Securing the locking pin to the collar will prevent the chance of misplacing or losing the pin when in a collapsed and stored position.

For collapsing the device, the locking pin 28 is removed. This will enable the collar to slide downward and towards the lower end 16 of the shaft 12. Thus providing for the device 10 to be in a folded and collapsed position.

Optionally, and as illustrated in FIG. 1, a conventional spring loaded button 26 can be secured to the main pole. In operation, if the spring-loaded pin is utilized, the user depresses the conventional spring-loaded button 26 inward, to allow for the collar 22 to slide freely over the button in an upward or downward position. When the collar is located above the spring-loaded button 26, the device 10 is in a display and extended position. When the collar is located below the spring-loaded button, the device is in a collapsed and storable position. This embodiment would eliminate the use of the plurality of apertures extending through the shaft.

Alternatively, the shaft can include both the spring-loaded button 26 and the plurality of apertures. In this arrangement, the use of the spring loaded button 26 is for safety and acts as a stop, so as to prevent the branches from collapsing and falling onto the user, should the user slip and loose his hold on the device during the installation process.

Securing the branches to the extending and lowering mechanism allows for them to be raised and lowered. Pivot rods are utilized for securing the branches to the collar, thus providing a pivotal arrangement. As seen in FIG. 1, the pivot rods 30 are pivotally sandwiched between the branches 18 extending and lowering mechanism 20. A ring 32 is permanently secured on each branch. The pivot rod is pivotally secured, via conventional means, to this ring 32. The opposite end of the pivot rod is pivotally secured, via conventional means, to the extending and lowering mechanism 20 (see FIG. 1).

As seen in FIGS. 1 and 3*b*, the pivot rod 30 includes opposite ends. Each end preferably includes an aperture for receiving a conventional pin or the like, for allowing each end to be pivotally attached to the ring 32 and the extending and lowering mechanism 20.

Optionally, and as seen in FIGS. 1 and 3*c*, a shank 34, can be secured above the collar 22. The opposite end of the pivot rod 30 can be pivotally secured to this shank 34.

The top end of each branch is secured to the main shaft 16 via an end cap 38. Due to this, when the extending and lowering mechanism 20 is locked into place, the pivot rods will be in a fixed and extended position. Lifting the extending and lowering mechanism 20 upward and higher will change the angular placement of the branch with respect to the main pole. The higher up the extending and lowering mechanism 20 is located on the pole or as the extending and lowering mechanism 20 approaches the top end 14 of the pole 12, the larger the angle.

The branches, as seen in FIGS. 1, 2 and 3*a*, are hollow in structure and are fabricated from a durable and substantially clear or transparent material. If desired, the transparent material can be colorized. Illuminated devices are located therein and basically comprise of conventional lights 36. The lights are conventional and any type or style of lights can be used to achieve the desired look. Preferably, tube lighting, roll type lighting, or hollow core rope lights, such as the ones produced by Action Lighting, sold as the Princess clear rope is desired. Since the lights are housed and maintained within the branches, they are preferably low voltage. The use of hollow branches provide a device which is durable and one that protects the illumination devices (conventional lights 36) from the harsh outdoors, as well as indoor, environment, during use and when in a stored position.

Each branch, which is substantially a hollow tube, includes an upper area and a lower area. As seen in FIG. 1, the upper area is pivotally secured to an end cap 38. The attachment between the upper area and the end cap, as illustrated in FIG. 3*a*, occurs pivotally, via flange 40 having a through hole 42 extending therein. The through hole receives prongs located within the end cap.

As seen in FIG. 3*a*, the upper end of the branch can be opened for allowing wiring 44 or the like, from the lights 36 located therein, to extend out from the branch. Optionally, the upper end can be closed so as to provide for the closed end to include an orifice. This orifice enables wiring 44 or the like, from the lights 36 located within the branch, to extend outward from the interior of the housing.

The structure of the lower area is dependent to the particular light source, which is used with the present invention. If the strands of lights are such that once coupled to the power source, an inherent closed loop is formed, then the lower area of each branch can be is closed. This will provide on the light source to be coupled to the power source via the coupling device located within the end cap.

If the lights must be coupled in series to each other at both the top end and lower end, as illustrated in FIG. 3*a*, then the lower end of the branch will be opened as illustrated or optionally, closed with an opening therein for enabling a conventional plug connection 46, from the conventional lights, to extend outwardly therefrom.

Figure 4A:
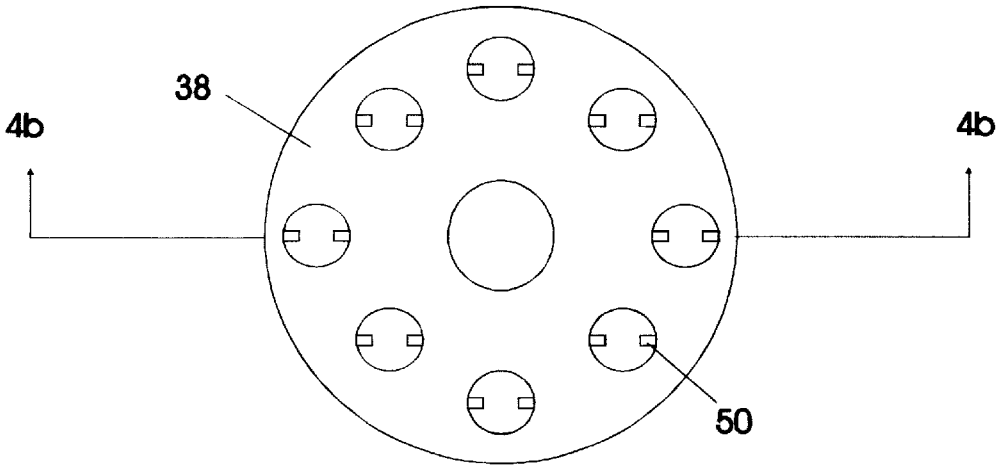
FIG. 4*a* is a bottom view of the end cap used in the illuminated tree structure of the present invention.
Figure 4B:
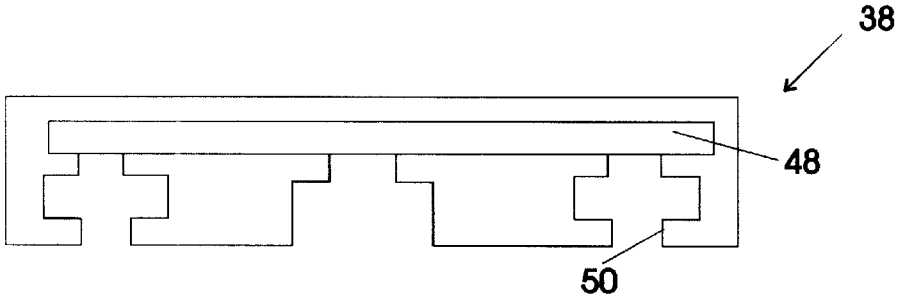
FIG. 4*b* is a cross-sectional view, taken along lines 4*b*—4*b* of FIG. 4*a*, of the end cap used in the illuminated tree structure of the present invention.

Enabling electrical connection between the branches and the power source is accomplished by the use of an end cap. The end cap 38 is illustrated in FIGS. 1, 4*a*, and 4*b*. As seen in these figures, the end cap 38 is secured to the upper end 14 of the shaft and enables power to be distributed to each branch for the illumination of the lights. This end cap 38, as seen, includes an upper portion and a lower portion. The upper portion houses a conventional connector block 48, such as the ones produced and sold by Action Lighting. The lower portion includes a plurality of recesses, which are designed and configured to receive the flanged portion of the branches. The center recess, within the end cap 38 will receive the main shaft 12.

The recesses for the branches include inward prongs 50. The through holes 42 of the flanges 40 in each branch will receive the inward prongs 50. In this configuration, the prongs will permit for the hollow branch to pivot during the lowering or raising of the branches. The central recess will receive the main shaft and does not require the pivotal attachment. This will provide for the center of the shaft to be permanently secured or, optionally, removably secured to the central recess so as to provide for the cap to be securely attached thereto and prevent movement between the shaft and the cap.

Located in proximity to each recess is an opening for receiving the wiring of the lights within each branch. This will enable the wiring to be coupled to the conventional connector block. Thereby, allowing for a closed looped system. Extending through the central recess and coupled to the conventional connector block 48 is the main cord 52. This main cord extends through the main shaft 12 and exits the shaft 12 via opening 54. This opening 54 is preferably located in proximity to the lower end 16 of the shaft. The main cord 52 includes a conventional plug connection that can include both male and female connection means.

Once the conventional plug connection of the main cord is attached to a conventional power source, such as connection the plug to a residential home wall socket, power is supplied to the tree for enabling illumination.

Figure 4C:
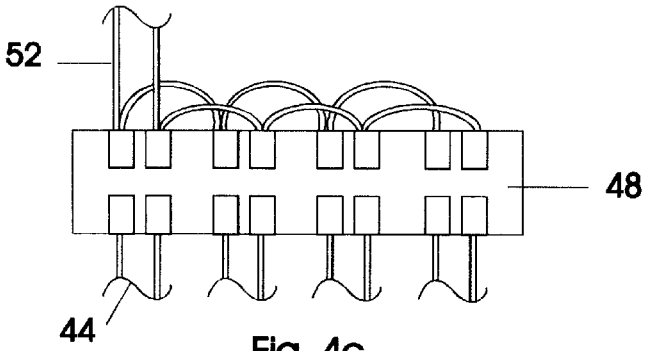
Fig. 4c Prior Art
FIG. 4*c* is a top view of a conventional connector block that can be used in the end cap for enabling electrically connection to occur with the lights used in the illuminated tree structure of the present invention.

FIG. 4*c* illustrates the wiring of a conventional connector block 48. This example of a conventional connector block 48 illustrates how the wiring is coupled in series to each other. As seen the wiring 44 from the lights are electrically coupled to each other and to the main cord 52. This will allow for continuous lighting to occur.

As seen in FIGS. 1 and 2, the lower end of the main shaft includes the attaching device 56 for attaching the illuminated tree to the ground. This attaching device comprises a stack 60. Located above the stake 58 is a foot press. In use, the user places their foot onto the foot press. Leaning and pushing downward, the user's strength in combination with their weight will cause the stake to extend into the ground and be secured therein. Alternatively, this stack can be replaced attaching device to have a coil like configuration. This will enable the main shaft to be twisted and turned into the ground.

While the invention has been particularly shown and described with reference to an embodiment thereof, it will be understood by those skilled in the art that various changes in form and detail may be made without departing from the spirit and scope of the invention.

I claim:

1. An illuminated tree device comprising:

a central shaft having a top end and a lower end;

an end cap is secured to said top end of said shaft;

a plurality of elongated hollow branches having a first end and a second end;

said first end of each branch is pivotally secured to said end cap;

an illuminating device is located within each of said plurality of elongated hollow branches;

a main cord for coupling to a conventional power supply extends through said shaft;

a coupling device is located within said end cap for electrically coupling each of said illuminating devices located within each of said plurality of elongated hollow branches and for electrically said illuminating device of each branch to said main cord; and an adjusting device for lifting and lowering said branches for providing said branches to be in a display position when raised and a storable position when lowered.

2. An illuminated tree device as in claim 1 wherein an attaching device is located on said lower end of said shaft for attaching said device to a surface.

3. An illuminated tree device as in claim 2 wherein said attaching device is a stake.

4. An illuminated tree device as in claim 3 wherein a footrest is located above said stake for assisting in securing said tree device to said surface.

5. An illuminated tree device as in claim 3 wherein said stack has a coil construction.

6. An illuminated tree device as in claim 1 wherein each second end of said plurality of elongated hollow branches includes an opening for enabling an electrical connection device to extend outwardly therefrom.

7. An illuminated tree device as in claim 1 wherein an opening is located in proximity to said lower end of said shaft for enabling an electrical connection device to extend outwardly therefrom.

8. An illuminated tree device as in claim 1 wherein said adjusting device comprises a collar slidably mounted to said central shaft and pivotally secured to said plurality of branches for enabling said braces to extend out when in use and collapse when in a stored position.

9. An illuminated tree device as in claim 8 wherein a plurality of apertures extend through said shaft in proximity to said top end, a pin is removable secured therein and extends outwardly when located within an aperture from said plurality of apertures, said pin acts as a stop to prevent said collar from moving along said shaft, said plurality of apertures acts as a branch extension means for achieving a desired extension of said branches.

10. An illuminated tree device as in claim 8 wherein a spring loaded button is secured to said central shaft said spring loaded button and when said collar is located above said spring loaded button said tree device is in a display position and when said collar is located below said spring loaded button, said tree device is in a collapsed position.

11. An illuminated tree device as in claim 9 wherein said pin is secured to said collar via a securing element.

12. An illuminated tree device as in claim 1 wherein said plurality of branches are transparent.

13. An illuminated tree device as in claim 12 wherein said branches are colorized.

14. An illuminated tree device as in claim 1 wherein said end cap includes a plurality of outer recesses and a center recess, said outer recesses receive said plurality of branches and said center recess receives said central shaft.

15. An illuminated tree device as in claim 14 wherein said outer recesses include inward prongs, said first end of each of said branch includes a flange having a through hole extending therein, said through hole receives said inward prongs for providing a pivotal connection.

16. An illuminated tree device as in claim 1 wherein said end cap includes upper portion and a lower portion, said upper portion a conventional connector block and said lower portion includes a plurality of outer recesses and a central recess, said outer recesses receive said plurality of branches and said center recess receives said central shaft.

17. An illuminated tree device as in claim 1 wherein said central shaft houses a main cord for enabling connection to a conventional power source.

18. An illuminated tree device as in claim 1 wherein a strap is removably secured around said branches when said device is in a collapsed and storable position.

* * * * *